US006059365A

United States Patent [19]

Diamond

[11] Patent Number: 6,059,365

[45] Date of Patent: May 9, 2000

[54] ORTHOPEDIC LOUNGE CHAIR

[76] Inventor: Penelope J. Diamond, 2205 Dobbs Rd. Unit #3, St. Augustine, Fla. 32086

[21] Appl. No.: 09/196,932

[22] Filed: Nov. 20, 1998

Related U.S. Application Data

[60] Provisional application No. 60/066,861, Nov. 28, 1997.

[51] Int. Cl.[7] ..... A47C 17/66

[52] U.S. Cl. ..... 297/354.13; 5/111; 5/652.1; 297/377; 297/900

[58] Field of Search ..... 297/284.5, 354.13, 297/377, 397, 486, 900; 5/110, 111, 652.1, 638, 725

[56] References Cited

U.S. PATENT DOCUMENTS

| | | | |
|---|---|---|---|
| D. 352,635 | 11/1994 | Yoder | 297/900 X |
| 2,236,770 | 4/1941 | Atwell | 5/638 X |
| 3,828,377 | 8/1974 | Eary, Sr. | 5/638 X |
| 4,606,086 | 8/1986 | Rowland | 297/900 X |
| 4,941,222 | 7/1990 | Prager | 5/111 |
| 5,297,850 | 3/1994 | Guleserian | 297/900 X |
| 5,829,080 | 11/1998 | Robillard et al. | 297/900 X |

*Primary Examiner*—Peter R. Brown
*Attorney, Agent, or Firm*—Thomas C. Saitta

[57] ABSTRACT

A lounge chair having an adjustable upper support section for either prone or seated use, where the upper support section is provided with a face opening and attachment means to removably attach a face pad, an abdominal/torso pad and a lumbar/breast pad. The upper support section may be inclined past horizontal and is supported by an upper end member of the frame. A pair of adjustable shoulder pads may also be attached to the upper support section. Preferably the face pad is thinner than the abdominal/torso pad and has a U-shape with the lateral sections being thicker than the bridging section.

17 Claims, 2 Drawing Sheets

ORTHOPEDIC LOUNGE CHAIR

This application claims the benefit of U.S. Provisional Application No. 60/066,861, filed Nov. 28, 1997.

BACKGROUND OF THE INVENTION

The invention relates to chairs of a type known as lounge chairs or loungers, where the chair supports the full body length of the user and is foldable so as to be able to support the user in either the seated or prone position. In particular, this invention relates to such chairs which provide an opening situated near the end of the chair adapted to support the user's head so that the user's face can be positioned in the opening when the user is lying face down.

Lounge chairs for supporting a person in either a prone or seated position and which have body support sections joined in a hinged manner to allow adjustment of the relative angle of adjacent support sections are known, and typically consist of a generally horizontal frame supported above a surface by legs, where a fabric or mesh material, in solid sheets or multiple strips, is stretched across the frame. The frame is hinged at a point roughly one third of the way from the head supporting end, and also sometimes at a point roughly one third of the way from the feet supporting end, so that the head and/or feet supporting sections can be variably angled relative to the horizontal middle section. This allows the device to be adjusted to provide relatively vertically oriented support to the user's back when a seated position is desired, with the head support section adjustable incrementally toward horizontal or beyond to provide the desired angle of support in a reclining or prone position. The hinged sections also allow the chair to be folded into a generally flat and compact configuration for transport or storage. A known improvement to the basic lounge chair is the provision of an opening in the head support section of the chair which is configured to receive in a supporting manner the face of a user lying in the face down prone position. This allows the user to relax in the face down position without having to turn the head to either side, and precludes hyper-extension of the neck when reading, since the book can be placed beneath the chair opening. Examples of such a chair is shown in U.S. Pat. No. 4,606,086 to Rowland, which provides a drawstring face opening, U.S. Pat. No. 3,897,102 to Lemaire, which provides openings for the arms as well as for the face, and U.S. Pat. No. 5,222,779 to Johnson, which provides lateral indentations for the arms. Although the head supporting sections of these devices are not shown to be extended past horizontal, other chairs are known which allow such an adjustment, which is preferred when in the face down prone position to reduce or relieve stress to the spine. An example of a chair having a head support section for the face down prone position at a fixed angle below horizontal is U.S. Pat. No. 5,297,850 to Guleserian.

It is an object of this invention to provide an improved folding lounge chair which is orthopedically superior to the known designs for lounge chairs, where the chair has an opening for the face and where the head support section is adjustable below horizontal. It is a further object to provide a lounge chair with removable and adjustable pad members which can be properly positioned to provide the most beneficial support and to create fulcrum points to relieve stress to the spine at various chosen locations from the neck to the lower back by positive traction effects. It is a further object to provide particularly configured support pads, both in size and shape, which work in conjunction with the face opening and the adjustable head support section to maximize comfort and therapeutic effect. These and other possible objects are to be accomplished as set forth in the descriptions below.

SUMMARY OF THE INVENTION

The lounge chair comprises a generally rectangular frame member which encompasses the lower body support section and the middle body support section, preferably hinged at the juncture of the two sections so as to allow the sections to be folded into a compact configuration for transport and storage, with leg members depending from the frame member to support the frame in a generally horizontal position a distance above an underlying surface. Preferably the leg members are hinged so that they may also be folded into a compact configuration. A body support material, such as a fabric or mesh, is attached across the frame to support the user. A pivotable upper body support section, also having a support material attached between its end and lateral members, is pivotally attached to the middle section of the frame member at a point interior to the upper end of the frame, such that an upper end member of the frame extends beneath the upper section, with the upper end member abutting and supporting the upper section when the upper section is fully reclined past horizontal. Adjustment support members for the upper section which interlock with the upper end of the frame member allow the upper section to be positioned at various angles relative to the frame member, from approximately vertical to approximately 15 degrees below horizontal. An opening, preferably generally triangular in configuration, sized to receive the face of the user when the user is in the face down prone position is provided in the upper section.

A number of removable and position-adjustable pad members are provided for attachment to the chair, preferably through hook and loop fastening means. A generally rectangular abdominal/torso pad, which can also be used under the legs when the user is in the seated position, is removably connected to the upper section at varying positions beneath the face opening. A generally elongated rectangular lumbar/breast pad is removably connected to the upper section in place of the abdominal/torso pad either transversely for support of the lumbar region in the sitting position or longitudinally to provide support between the breasts for women in the face down prone position. A generally U-shaped face pad member is removably connected to upper section so as to encircle the face opening, where the open end of the face pad is directed toward the lower end for use in a face down prone position and where the open end of the face pad is directed toward the upper end of the upper section for use in a supine or seated position. Preferably a pair of laterally adjustable shoulder pad members are connected to the upper section between the face pad and the abdomen/torso pad, where the shoulder pad members can be positioned to the side or underneath the upper section when not in use. Preferably, the abdomen/torso pad is approximately three inches thick, the lumbar/breast pad is approximately two to three inches thick, the lateral segments of the U-shaped face pad are approximately two inches thick and the bridging segment is approximately one inch thick, such that the combination of the upper section being angled below horizontal and the diminishing thicknesses of the pads produces passive traction in a face down prone user to relieve spinal stresses and provide therapeutic effect to the user.

DETAILED DESCRIPTION OF THE INVENTION

With reference to the drawings, the invention will now be described with regard for the best mode and the preferred embodiment. In its most general sense, the invention is a lounge chair of the type which is conformable into multiple supportive positions for a user's body, the chair being of sufficient length to support the entire body, where the chair may be disposed in a relatively horizontal configuration to support the user in a fully prone manner or may be disposed with an end section pivotally raised from horizontal to a generally vertical position to support the user in a seated manner.

Figure 1:
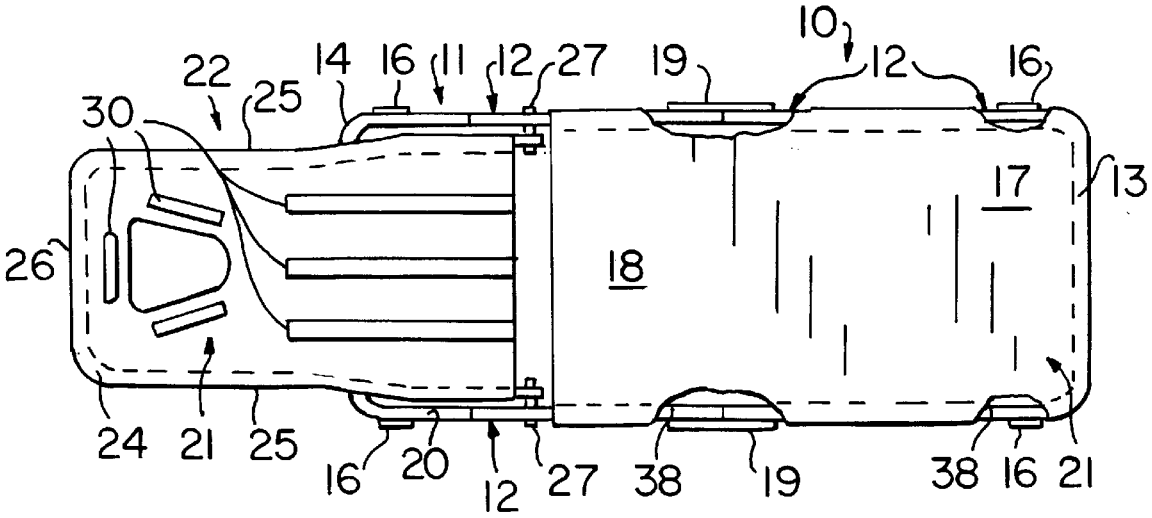
FIG. 1 is a top view of the invention with the pads removed.
Figure 3:
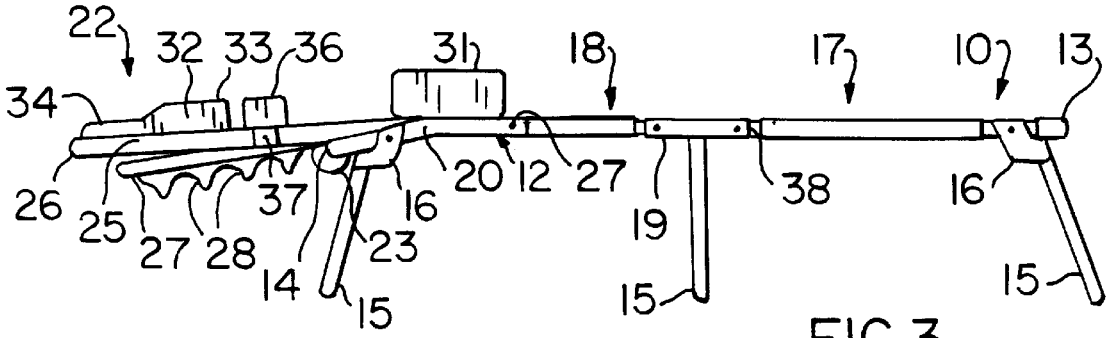
FIG. 3 is a side view of the invention in the prone position.
Figure 5:
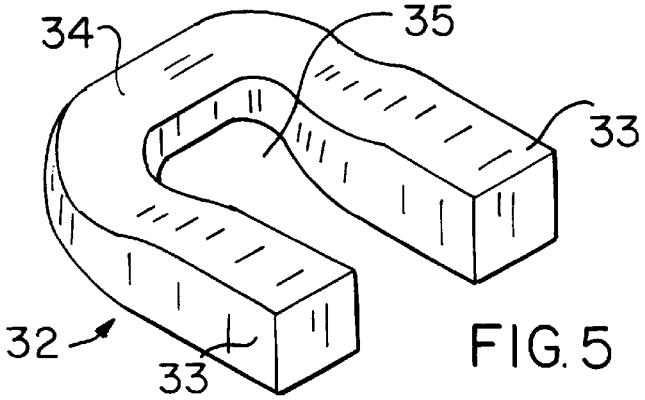
FIG. 5 is a perspective view of the face pad.
Figure 2:
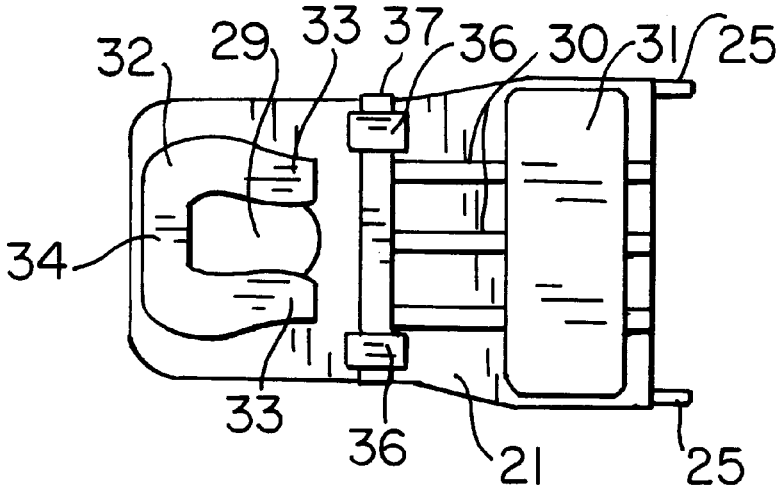
FIG. 2 is a top view of the upper section of the invention showing the pads in use.
Figure 4:
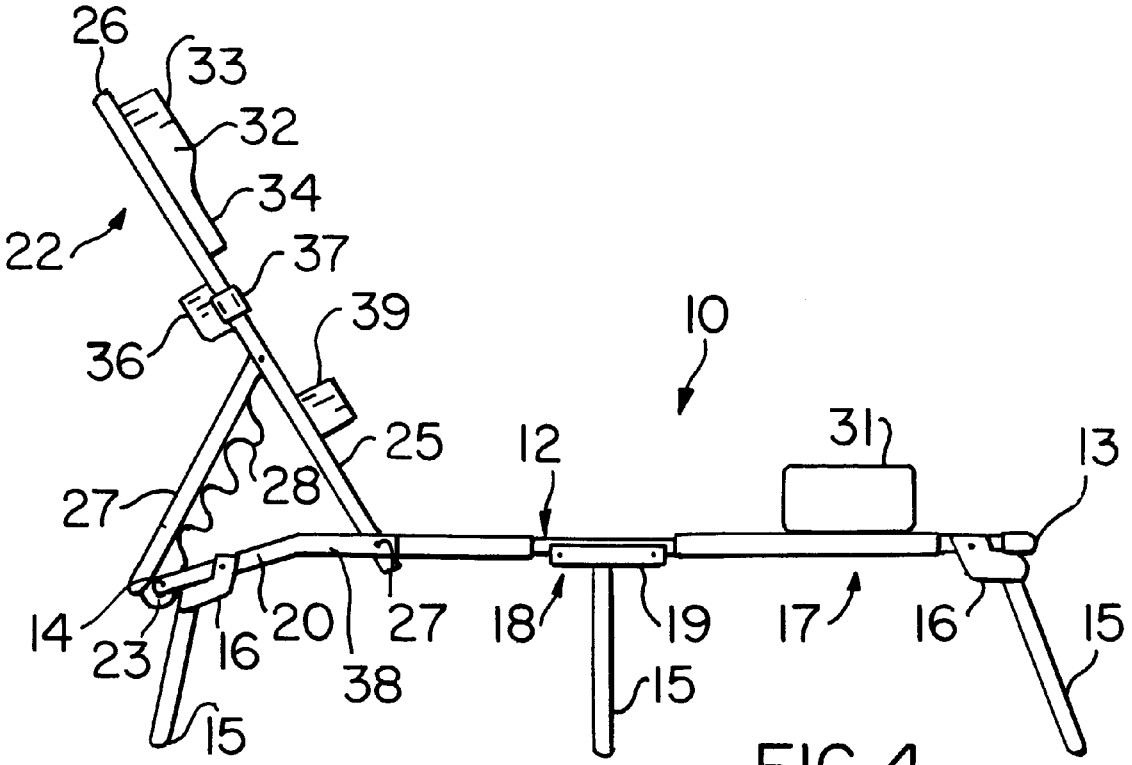
FIG. 4 is a side view of the invention in the seating position.

As seen in FIGS. 1, 3 and 4, the invention is a lounge chair 10 comprising a generally rectangular frame member 11 supporting a body support material 21 in a relatively taut manner, the frame member 11 comprising a pair of opposing lateral members 12, a lower end member 13 and an upper end member 14. For reference herein, the lower direction shall be taken as the direction toward the portion of the chair 10 which supports the feet of the user, i.e., toward the non-adjustable end, and the upper direction shall be taken as the direction toward the portion of the chair 10 which supports the head of the user, i.e., toward the adjustable end. Frame member 11 is preferably composed of lightweight, strong tubing, which may be aluminum, PVC or the like, such that the rectangular configuration is relatively rigid and capable of sustaining the body weight of a person. The body support material 21 is likewise capable of sustaining the weight of a user without excessive deflection, and may be composed of any suitable sheet member, such as a fabric or mesh of natural or synthetic fibers, or alternatively may comprise a large number of strips or tubes aligned in parallel or perpendicular patterns to provide sufficient support to the user. The body support material 21 may be affixed by any suitable method to the frame member 11, such as by mechanical fasteners or adhesives, or preferably by stitching the material 21 along the edges of the frame member 11, and is attached along both lateral sides 12 and preferably along the lower end member 13. The body support material 21 does not fully extend to the upper end member 14 of the frame 11, instead covering about two-thirds to three-quarters of the total area of the frame member 10, thereby allowing for connection of the pivoting upper support section 22.

The frame 11 is horizontally supported a distance above an underlying support surface, such as a floor or the ground, by a plural number of leg members 15, which may be composed of any suitably strong and durable material capable of supporting the weight of a user, but are preferably composed of material similar to that composing the frame member 11—metal or plastic tubing. Preferably the leg members 15 are configured with generally wide bases or feet, and most preferably are configured as U-shaped with the ends of the "U" connected to the frame member 11, so that the frame 11 will be suitably supported without sinking when used outdoors on the ground or in the sand. Also most preferably the leg members 15 are connected to the frame member 11 by hinge members 16, such that the legs 15 may be folded against the frame 11 to create a smaller configuration when the chair 10 is being transported or stored. Any suitable hinging mechanism may be used for the leg hinge members 16, but preferably the hinge members 16 having a locking mechanism, such as a depressible pin which interlocks with an aperture to lock the legs 16 in the extended position, so that there is no likelihood of the chair 10 accidentally collapsing during use. So that the chair 10 is more easily used by person's with physical handicaps or injuries, and especially for use with wheelchairs, the leg members 16 are preferably of greater length than the legs of standard lounge chairs, preferably of a length to support the frame member 11 approximately eighteen inches above the underlying support surface.

The frame member 11 and body support material 21 together define two segments, a lower support section 17 and a middle support section 18. The lower support section 17 encompasses the area of the body support material 21 between the lower end member 13 and approximately the lower halves of the lateral members 12. The middle support section 18 encompasses the area of the body support material 21 between the remaining portions of the lateral members 12. In use, the lower support section 17 will support the legs of the user and the middle support section 18 will support the buttocks of the user in a seated position or the waist area of a user in the prone position. Preferably, the lateral members 12 of the frame 11 are each divided at the midpoint and connected by a frame hinge member 19 attached to a supporting leg member 15, such that the frame member 11 can be folded in half for transport or storage.

As seen best in FIGS. 3 and 4, a short segment 20 of the upper sections of each of the lateral frame members 12 is angled downward toward the underside of the body support material 21, such that the upper end member 14 is lower than the lower end member 13 when the chair 10 is placed on a level surface. The angle between the plane containing the extended, horizontal portions 38 of the lateral members 12 and the plane containing the depending segments 20 is sufficient such that, as will be explained in more detail below, the upper support section 22 when abutting the upper end member 14 of the frame 11 will be positioned at an angle below that of the plane containing the horizontal portions 38 of the frame 11, i.e., the plane containing the upper support section 22 will be below horizontal when frame member 11 is positioned horizontally. Preferably the short segments 20 will be at an angle relative to the extended, horizontal portions of the frame member 11 of between approximately 175 and 165 degrees, and most preferably at approximately 172 degrees. A frame pad 23 comprising a thick tube of expanded polymer foam or similarly compressible material may be positioned on upper end member 14 to provide cushioning under the body support material 21 of the upper support section 22 when it is placed in the lowermost position.

The upper support section 22 is preferably composed of material similar to that of the frame member 11, such as tubular metal or plastic, and is generally rectangular with preferably a U-shaped frame 24 having a pair of opposing lateral members 25 joined by an upper end member 26. Lateral members 25 may be linear, but are preferably configured with a reduced separation distance toward the upper portion of the upper support section 22 such that the user's arms easily clear the outside of the lateral members 25 when the user is in the face-down prone position and desires the arms to extend below the upper support section 22. As with the frame member 11, a body support material of any suitable type is tautly attached across the area between the lateral members 25 and the upper end member 26. The upper support section 22 is pivotally attached to the frame member 11 by pivot means 27, which may comprise a pin inserted through apertures in the free ends of each upper section lateral member 25 and each frame lateral member 12. Because of this attachment, the upper support section 22 may be positioned at various angles relative to the frame member 11, from a nearly vertical seating position as shown in FIG. 4 to a prone position as shown in FIG. 3. The upper support section 22 is fixed in place and supported at the desired position by support member 27, which preferably comprises a generally U-shaped piece of metal or plastic tubing which is pivotally attached near the midpoint of the upper section lateral members 25, the support member 27 further comprising incremental sockets or brackets 28 which receive the upper end member 14 of the frame 11, with the particular set of sockets 28 chosen by the user determining the angle of the upper support section 22 relative to the frame 11. Other equivalent means for temporarily supporting the upper support section 22 in an angled positioned could also be utilized. In the most prone configuration, as shown in FIG. 3, the upper support section 22 rests directly on the frame upper end member 14, with support member 27 not utilized. Thus the frame upper end member 14 provides very stable support for the upper support section 22 when the weight of the user on that section will be at a maximum.

The body support material 21 of the upper support section 22 is provided with a face opening 29, which may comprise many suitable shapes and as shown is configured with a generally triangular shape, the apex of the triangle being positioned below the base of the triangle. Face opening 29 allows the user, with the chair 10 in the horizontal configuration, to occupy the chair 10 in the face-down prone position with the user's face positioned at the face opening 29. This allows the user to lie face down without having to turn the head to one side, since the user can easily breathe through the face opening 29, as well as read books or magazines placed beneath the chair 10 on the ground or held in the user's arms. The body support material 21 of the upper support section 22 is provided with pad attachment means 30, preferably the loop component of a hook and loop type fastener, on the lower half of the upper support section 22 below the face opening 29 and extending to the bottom of the upper support section 22. Pad attachment means 30, also preferably the loop component of a hook and loop type fastener, are provided on the body support material 21 around the face opening 29.

The chair 10 further comprises a plural number of slightly compressible pad members which comprise supportive filler materials, such as polymer foam or the like, encased in durable covers, which are configured for particular uses and placement on the chair 10. One such pad is the abdominal/torso pad 31, which is generally rectangular in configuration and is preferably the thickest of all the pad members, being preferably about three inches in thickness, and is approximately equal in width to the width of the frame 11. Abdominal/torso pad 31 is provided with means to removably affix it to the body support material 21 at a chosen position on the upper support section 22, which may comprise the corresponding hook component of the pad attachment means 30. The abdominal/torso pad 31 is positioned on the lower half of the upper support section 22 to provide support or positive traction effects when the user is in the prone position, or may be moved to the lower support section 17 to support the legs if desired.

The second pad is the head pad 32, which is designed for use around the face opening 29. The head pad 32 is generally U-shaped, with a pair of lateral sections 33 joined by a bridging section 34 to define an open central area 35. Lateral sections 33 are preferably curved to provide more comfortable support to the head or face. Preferably the bridging section 34 is thinner than the lateral sections 33, and most preferably the lateral sections 33 are thinner than the abdominal/torso pad 31, with the bridging section 34 being about one inch thick and the lateral sections 33 being about two inches thick. The head pad 32 is also provided with means to removably affix it to the body support material 21, which may comprise the corresponding hook components of the pad attachment means 30. When the user is in the prone position, the head pad 32 is affixed around the face opening 29 with the thin bridging section 34 at the uppermost position. When the user is in the seated position, the head pad 32 is reversed so that the thin bridging section 35 is lower than the face opening 29.

The third pad is the lumbar/breast pad 39, which is a generally elongated rectangular pad approximately two to three inches thick and long, with a width equal to the width of the frame 11. The lumbar/breast pad 39 is provided with means to removably affix it to the body support material 21 at a chosen position on the upper support section 22, which may comprise the corresponding hook component of the pad attachment means 30. The lumbar/breast pad 39 is used in place of the abdominal/torso pad 31 for certain situations, and is positioned transversely across the lower half of the upper support section 22 to provide support or positive traction effects to the lumbar region of the user when in the seated position, or is positioned longitudinally to provide support between the breasts when the user is in the prone position.

Another set of pad members which may be included on the chair 10 are a pair of shoulder pads 36, which may be configured as rectangular pads, preferably of thickness equal to that of the lateral sections 35 of the head pad 32. The shoulder pads 36 are also attached to the chair 10 in are movable or movable manner, and preferably are attached by inserting an encircling strap member 37 through the shoulder pads 36, with the strap 37 wrapped around the lateral members 25 of the upper support frame 24 just below the face opening 29. This allows the shoulder pads 36 to be moved laterally and longitudinally, as well as allowing the shoulder pads 36 to be slipped to the sides or behind the upper support section 22 if they are not required for support.

The chair 10 is especially suited for use by those with back and neck problems, such as where turning the head to either side is difficult or where pressure relief to the spinal disks is desirable. The combination of the head pad 32 and abdominal/torso pad 31, especially when the upper support section 22 is fully reclined to be below horizontal, and in particular the combination resulting from the diminishing thicknesses of the pads 32 and 31 as described, provides a means to deliver passive traction to the user. The thick abdominal/torso pad 31 can be placed at any location along the spinal column from neck to lower back so as to act as a fulcrum to relieve pressure on that area of the spine. The reduction in thickness of the head pad 32 from the lateral sections 33 to the bridging section 34 best conforms to the facial skeletal structure and provides the proper head angle relative to the spine when the user is in the face-down prone position or, when inverted, in the seated position, to reduce or eliminate cervical hyper-extension.

It is contemplated that certain equivalents and substitutions for components set forth above may be obvious to those skilled in the art, and thus the true scope and definition of the invention is to be as set forth in the following claims.

I claim:

1. In a lounge chair having a generally rectangular frame supporting a body support material and defining a lower support section and a middle support section, the rectangular frame comprising a pair of lateral members joined by a lower end member and an upper end member, legs connected to and supporting the rectangular frame above a surface in a generally horizontal position, and an upper support section having a frame supporting a body support material and pivotally connected to the rectangular frame whereby the upper support section can be adjusted to various positions from a relatively vertical position to a position below horizontal, the body support material of the upper support section having a face opening such that the face of a user in the face down prone position can be positioned within the face opening, the improvement comprising:

said lateral members comprising extended horizontal portions and a pair of depending segments angled downward from the plane containing the extended horizontal portions, where said upper end member is connected to said depending segments such that said upper support section abuts said upper end member when said upper support section is positioned below horizontal in the lowermost position.

2. The lounge chair of claim 1, the improvement further comprising a head pad removably attached to said body support material of said upper support section around said face opening, and a generally rectangular abdominal/torso pad removably attached to said body support material of said upper support section below said face opening.

3. The lounge chair of claim 2, where said head pad and said abdominal/torso pad are removably attached to said body support material of said upper support section by hook and loop type fasteners.

4. The lounge chair of claim 2, where said head pad is thinner than said abdominal/torso pad.

5. The lounge chair of claim 4, where said head pad is generally U-shaped, comprising a pair of lateral sections connected by a bridging section to define an open central section.

6. The lounge chair of claim 5, where said lateral sections are thicker than said bridging section.

7. The lounge chair of claim 6, where said abdominal/torso pad is approximately three inches thick, said lateral sections of said head pad are approximately two inches thick, and said bridging section of said head pad is approximately one inch thick.

8. The lounge chair of claim 2, the improvement further comprising a pair of shoulder pads removably attached to said upper support section, where said shoulder pads can be adjusted both laterally and longitudinally.

9. The lounge chair of claim 8, where said shoulder pads are attached to said upper support section by a strap encircling said upper support section.

10. The lounge chair of claim 2, the improvement further comprising a lumbar/breast pad having a generally elongated rectangular shape removably attached to said body support material of said upper support section below said face opening.

11. The lounge chair of claim 1, where said depending segments are at an angle to said extended horizontal portions of said lateral members of between approximately 175 and 165 degrees.

12. The lounge chair of claim 11, further comprising a frame pad positioned on said upper end member.

13. In a lounge chair having a generally rectangular frame supporting a body support material and defining a lower support section and a middle support section, the rectangular frame comprising a pair of lateral members joined by a lower end member and an upper end member, legs connected to and supporting the rectangular frame above a surface in a generally horizontal position, and an upper support section having a frame supporting a body support material and pivotally connected to the rectangular frame whereby the upper support section can be adjusted to various positions from a relatively vertical position to a position below horizontal, the body support material of the upper support section having a face opening such that the face of a user in the face down prone position can be positioned within the face opening, the improvement comprising:

a head pad removably attached to said body support material of said upper support section around said face opening, and a generally rectangular abdominal/torso pad removably attached to said body support material of said upper support section below said face opening, where said head pad is thinner than said abdominal/torso pad, and where said head pad is generally U-shaped, comprising a pair of lateral sections connected by a bridging section to define an open central section, where said lateral sections are thicker than said bridging section.

14. The lounge chair of claim 13, where said head pad and said abdominal/torso pad are removably attached to said body support material of said upper support section by hook and loop type fasteners.

15. The lounge chair of claim 13, where said abdominal/torso pad is approximately three inches thick, said lateral sections of said head pad are approximately two inches thick, and said bridging section of said head pad is approximately one inch thick.

16. The lounge chair of claim 13, the improvement further comprising a pair of shoulder pads removably attached to said upper support section, where said shoulder pads can be adjusted both laterally and longitudinally.

17. The lounge chair of claim 13, the improvement further comprising a lumbar/breast pad having a generally elongated rectangular shape removably attached to said body support material of said upper support section below said face opening.

* * * * *